United States Patent [19]

Gabriel et al.

[11] Patent Number: 4,859,358

[45] Date of Patent: Aug. 22, 1989

[54] LIQUID AUTOMATIC DISHWASHING COMPOSITIONS CONTAINING METAL SALTS OF HYDROXY FATTY ACIDS PROVIDING SILVER PROTECTION

[75] Inventors: Steven M. Gabriel, Cincinnati; Brian J. Roselle, Fairfield, both of Ohio

[73] Assignee: The Procter & Gamble Company, Cincinnati, Ohio

[21] Appl. No.: 204,444

[22] Filed: Jun. 9, 1988

[51] Int. Cl.[4] ..... C11D 3/02; C11D 3/20; C11D 17/08; C23F 11/10

[52] U.S. Cl. ..... 252/99; 252/89.1; 252/97; 252/135; 252/140; 252/174.24; 252/174.25; 252/389.52; 252/389.53; 252/396; 422/13; 422/17; 422/19

[58] Field of Search ..... 252/89.1, 96, 97, 99, 252/108, 109, 135, 140, 174.24, 174.25, 389.52, 389.53, 396; 422/13, 17, 19

[56] References Cited

U.S. PATENT DOCUMENTS

| | | | |
|---|---|---|---|
| 2,674,619 | 4/1954 | Lundsted | 260/485 |
| 2,677,700 | 5/1954 | Jackson et al. | 260/488 |
| 2,979,528 | 4/1961 | Lundsted | 260/584 |
| 3,036,118 | 5/1962 | Jackson et al. | 260/484 |
| 3,048,548 | 8/1962 | Martin et al. | 252/135 |
| 3,255,117 | 6/1966 | Knapp et al. | 252/99 |
| 3,314,891 | 4/1967 | Schmolka et al. | 252/89 |
| 3,352,785 | 11/1967 | Corliss et al. | 252/99 |
| 3,893,825 | 7/1975 | Goeller | 44/66 |
| 3,899,387 | 8/1975 | Freis et al. | 162/158 |
| 4,006,091 | 2/1977 | Lindblom et al. | 252/90 |
| 4,095,035 | 6/1978 | Lamberti et al. | 560/180 |
| 4,147,650 | 4/1979 | Sabatelli et al. | 252/103 |
| 4,215,004 | 7/1980 | Borgerding et al. | 252/156 |
| 4,226,736 | 10/1980 | Bush et al. | 252/135 |
| 4,240,919 | 12/1980 | Chapman | 252/95 |
| 4,436,637 | 3/1984 | Ramachandran et al. | 252/8.7 |
| 4,491,539 | 1/1985 | Hoskins et al. | 252/541 |
| 4,522,740 | 6/1985 | Schmid et al. | 252/174.21 |
| 4,548,729 | 10/1985 | Schmid et al. | 252/174.21 |
| 4,608,188 | 8/1986 | Parker et al. | 252/99 |
| 4,620,936 | 11/1986 | Kielman et al. | 252/99 |
| 4,624,803 | 11/1986 | Balzer et al. | 252/527 |
| 4,661,280 | 4/1987 | Ouhadi et al. | 252/99 |
| 4,686,254 | 8/1987 | Lochhead et al. | 524/99 |
| 4,703,114 | 10/1987 | Mori et al. | 536/4.1 |
| 4,726,909 | 2/1988 | Otten et al. | 252/174.21 |
| 4,740,327 | 4/1988 | Julemont et al. | 252/103 |
| 4,752,409 | 6/1988 | Drapier et al. | 252/94 |

FOREIGN PATENT DOCUMENTS

| | | |
|---|---|---|
| 0082564 | 6/1983 | European Pat. Off. . |
| 197434 | 10/1986 | European Pat. Off. . |
| 0239379 | 9/1987 | European Pat. Off. . |
| 264826 | 4/1988 | European Pat. Off. . |
| 264975 | 4/1988 | European Pat. Off. . |
| 2615698 | 10/1977 | Fed. Rep. of Germany . |
| 2854484 | 6/1980 | Fed. Rep. of Germany . |
| 3023828 | 2/1982 | Fed. Rep. of Germany . |
| 62-032198 | 2/1987 | Japan . |
| 63-061093 | 3/1988 | Japan . |
| 1527706 | 10/1978 | United Kingdom . |
| 2048841 | 12/1980 | United Kingdom . |
| 2116199 | 9/1983 | United Kingdom . |
| 2140450 | 11/1984 | United Kingdom . |
| 2164350 | 3/1986 | United Kingdom . |
| 2176495 | 12/1986 | United Kingdom . |
| 2185037 | 7/1987 | United Kingdom . |
| 2193724 | 2/1988 | United Kingdom . |
| 2194954 | 3/1988 | United Kingdom . |
| 2196972 | 5/1988 | United Kingdom . |

OTHER PUBLICATIONS

Product Literature for Carbopol 600 Series form B. F. Goodrich Company.

*Primary Examiner*—Dennis Albrecht
*Assistant Examiner*—A. Beadles-Hay
*Attorney, Agent, or Firm*—Gretchen R. Hatfield; Donald E. Hasse; Thomas H. O'Flaherty

[57] ABSTRACT

Thickened aqueous automatic dishwashing detergent compositions containing optional bleach-stable surfactant, detergency builder, hypochlorite bleach (to yield available chlorine), a thickening agent and metal salts of long chain hydroxy fatty acids. The compositions have a yield value between 50 and 350 dynes/cm$^2$ and inhibit tarnishing of sterling and silver-plated flatware.

27 Claims, No Drawings

LIQUID AUTOMATIC DISHWASHING COMPOSITIONS CONTAINING METAL SALTS OF HYDROXY FATTY ACIDS PROVIDING SILVER PROTECTION

TECHNICAL FIELD AND BACKGROUND ART

This invention relates to aqueous automatic dishwashing detergent compositions which have a yield value and are shear-thinning. Compositions of this general type are known. Examples of such compositions are disclosed in U.S. Pat. No. 4,116,851 to Rupe et al, issued September 26, 1978; U.S. Pat. No. 4,431,559 to Ulrich, issued Feb. 14, 1984; U.S. Pat. No. 4,511,487 to Pruhs et al, issued April 16, 1985; U.S. Pat. No. 4,512,908 to Heile, issued April 23, 1985; Canadian Patent 1,031,229, Bush et al; European Patent Application 0130678, Heile, published Jan. 9, 1985; European Patent Application 0176163, Robinson, published April 2, 1986; UK Patent Application 2,116,199A, Julemont et al, published Sept. 21, 1983; UK Patent Application 2,140,450A, Julemont et al, published Nov. 29, 1984; UK Patent Application 2,163,447A, Colarusso, published Feb. 26, 1986; and UK Patent Application 2,164,350A, Lai et al, published March 19, 1986.

U.K. Patent Application 2,176,495A, to Drapler et al, published December 31, 1986, discloses incorporation of 0.1 to 0.2 wt. percent of a polyvalent metal salt of a long chain fatty acid in a gel-like automatic dishwasher detergent composition to improve stability of the composition. Aluminum tristearate is taught to be the preferred salt.

U.K. Patent Application 2,185,037A, Dixit (Colgate), published July 8, 1987, discloses that aqueous cleaning compositions containing inorganic builder salts and other functional inorganic salts, chlorine bleach, and bleach-stable surfactant are transformed into thixotropic liquid automatic dishwasher detergent compositions by incorporation of 0.03 to 0.5 wt. percent of stearic acid.

It has now been found that incorporation of metal salts of long chain hydroxy fatty acids into automatic dishwashing detergent compositions inhibits tarnishing of sterling and silver-plated flatware in products containing bleach and caustic.

The state of the art liquid automatic dishwashing detergent compositions typically thickened with clay still suffer from phase separation upon storage under certain conditions. However, it has now been discovered that such compositions are improved by the utilization of certain thickening and stabilizing agents. More specifically, automatic dishwashing detergent compositions comprising a polycarboxylate thickener and certain phosphate ester stabilizers have improved phase stability and cohesiveness.

The use of polyacrylic thickeners in liquid automatic dishwashing detergent compositions is known. See, for example, U.K. Patent Application 2,185,037, Dixit, published July 8, 1987, which discloses liquid automatic dishwashing detergents which contain a long chain carboxylic or polycarboxylic acid as the thickener. Also, European Patent Application 0239379, Brumbaugh, published September 9, 1987, teaches that polyacrylate is useful for water spot reduction in liquid automatic dishwashing detergent compositions. U.S. Pat. No. 4,226,736 to Bush et al, issued October 7, 1980, teaches that a polymer of acrylic acid can be used as a thickener in liquid automatic dishwashing detergents instead of clay.

The use of phosphate esters, in general, in automatic dishwashing detergent compositions is also known. See, for example, U.K. Patent Application 2,116,199, Julemont et al, published September 21, 1983, which teaches the use of an alkyl ester of phosphoric acid as a foam depressor.

The combination of polyacrylate thickeners and phosphate ester plus clay has also been taught in U.K. Patent Application 1,164,350, Lai et al, published March 19, 1986. The polyacrylate thickeners taught to be useful have molecular weights of up to 500,000 (preferably up to 50,000). These compositions are said to be useful for protection of glazing on fine china.

Enhanced phase stability and improved dispensing of the product from its container are achieved if a polyacrylate thickener and phosphate ester component are used together in the absence of clay in the automatic dishwashing detergent compositions disclosed herein.

SUMMARY OF THE INVENTION

The compositions of this invention are thickened liquid aqueous automatic dishwasher detergent compositions comprising:

(1) from 0% to about 5%, preferably from about 0.1% to about 2.5%, of a bleach-stable, preferably low-foaming, detergent surfactant;

(2) from about 5% to about 40%, preferably from about 15% to about 30%, of a detergency builder, especially a builder selected from the group consisting of sodium tripolyphosphate, sodium carbonate, potassium pyrophosphate, sodium pyrophosphate, and mixtures thereof;

(3) a hypochlorite bleach to yield available chlorine in an amount from about 0.3% to about 2.5%, preferably from about 0.5% to about 1.5%;

(4) from about 0.25% to about 25%, preferably from about 0.5% to 2%, of a thickening agent; and (5) from about 0.05% to about 0.3% of a metal salt of a long chain hydroxy fatty acid;

said composition having a yield value of from about 50 to about 350, preferably from about 100 to about 250.

DETAILED DESCRIPTION OF THE INVENTION

Hydroxy Fatty Acid Salt

Because automatic dishwashing detergent compositions contain bleach, sterling or silver-plated flatware can become tarnished after repeated exposures to the composition. Metal salts of long chain hydroxy fatty acids have now been found to be useful in automatic dishwashing detergent compositions of this type to inhibit said tarnishing. By "long chain hydroxy fatty acid" is meant the higher aliphatic hydroxy fatty acids having from about 8 to about 22 carbon atoms, preferably from about 10 to 20 carbon atoms, and most preferably from about 12 to 18 carbon atoms, inclusive of the carbon atom of carboxyl group of the fatty acid. Hydroxy stearic acid is especially preferred. By "metal salts" of the long chain hydroxy fatty acids is meant both monovalent and polyvalent metal salts particularly the sodium, potassium, lithium, aluminum and zinc salts. Particularly preferred is the lithium salts of the hydroxy fatty acids. Specific examples of the preferred materials are potassium, sodium and particularly lithium hydroxy stearate. The compounds are compatible with bleach and other components traditionally found in automatic dishwashing detergent compositions. These compounds are essentially insoluble in water. Because of the presence of the hydroxy group in these compounds, they do not significantly affect viscosity of the compositions of the present invention. Thus, the hydroxy fatty acid salts are useful in connection with thickening agents such as clay or polycarboxylate thickeners in automatic dishwashing detergent compositions. The metals salts of long chain hydroxy fatty acids should be incorporated into the automatic dishwashing detergent compositions of the present invention at from about 0.05% to about 0.3%, preferably from about 0.05% to about 0.2%, by weight of the detergent composition.

Bleach-Stable Detergent Surfactants

The compositions of this invention can contain from 0% to about 10%, preferably from about 0.1% to about 5%, or more preferably from about 0.2% to about 3% of a bleach-stable detergent surfactant based upon the desired end use. The choice of detergent surfactant and amount will depend upon the end use of the product. For example, for an automatic dishwashing product the level of surfactant should be less than about 5%, preferably less than about 3%, and the detergent surfactant should be low sudsing.

Desirable detergent surfactants, in general, include nonionic detergent surfactants, anionic detergent surfactants, amphoteric and zwitterionic detergent surfactants, and mixtures thereof.

Examples of nonionic surfactants include:

(1) The condensation product of 1 mole of a saturated or unsaturated, straight or branched chain, alcohol or fatty acid containing from about 10 to about 20 carbon atoms with from about 4 to about 50 moles of ethylene oxide. Specific examples of such compounds include a condensation product of 1 mole of coconut fatty acid or tallow fatty acid with 10 moles of ethylene oxide; the condensation of 1 mole of oleic acid with 9 moles of ethylene oxide; the condensation product of 1 mole of stearic acid with 25 moles of ethylene oxide; the condensation product of 1 mole of tallow fatty alcohols with about 9 moles of ethylene oxide; the condensation product of 1 mole of oleyl alcohol with 10 moles of ethylene oxide; the condensation product of 1 mole of $C_{19}$ alcohol and 8 moles of ethylene oxide; and the condensation product of one mole of $C_{18}$ alcohol and 9 moles of ethylene oxide.

The condensation product of a fatty alcohol containing from 17 to 19 carbon atoms, with from about 6 to about 15 moles, preferably 7 to 12 moles, most preferably 9 moles, of ethylene oxide provides superior spotting and filming performance. More particularly, it is desirable that the fatty alcohol contain 18 carbon atoms and be condensed with from about 7.5 to about 12, preferably about 9, moles of ethylene oxide. These various specific $C_{17}$–$C_{19}$ ethoxylates give extremely good performance even at lower levels (e.g., 2.5%–3%) and at the higher levels (less than 5%) are sufficiently low sudsing, especially when capped with a low molecular weight ($C_{1-5}$) acid or alcohol moiety, so as to minimize or eliminate the need for a suds-suppressing agent. Suds-suppressing agents in general tend to act as a load on the composition and to hurt long term spotting and filming characteristics.

(2) Polyethylene glycols or polypropylene glycols having molecular weight of from about 1,400 to about 30,000, e.g., 20,000; 9,500; 7,500; 6,000; 4,500; 3,400; and 1,450. All of these materials are wax-like solids which melt between 110° F. and 200° F.

(3) The condensation products of 1 mole of alkyl phenol wherein the alkyl chain contains from about 8 to about 18 carbon atoms and from about 4 to about 50 moles of ethylene oxide. Specific examples of these nonionics are the condensation products of 1 mole of decylphenol with 40 moles of ethylene oxide; the condensation product of 1 mole of dodecyl phenol with 35 moles of ethylene oxide; the condensation product of 1 mole of tetradecylphenol with 25 moles of ethylene oxide; the condensation product of 1 mole of hectadecylphenol with 30 moles of ethylene oxide, etc.

(4) Polyoxypropylene, polyoxyethylene condensates having the formula $HO(C_2H_4O)_x(C_3H_6O)_y(C_2H_4O)_xH$ or $HO(C_3H_6O)_y(C_2H_4O)_x(C_3H_6O)_yH$ where total y equals at least 15 and total $(C_2H_4O)$ equals 20% to 90% of the total weight of the compound and the molecular weight is from about 2,000 to about 10,000, preferably from about 3,000 to about 6,000. These materials are, for example, the Pluronics which are well known in the art.

(5) The compounds of (1) which are capped with propylene oxide, butylene oxide and/or short chain alcohols and/or short chain fatty acids, e.g., those containing from 1 to about 5 carbon atoms, and mixtures thereof.

Useful surfactants in detergent compositions are those having the formula $RO—(C_2H_4O)_xR^1$ wherein R is an alkyl or alkylene group containing from 17 to 19 carbon atoms, x is a number from about 6 to about 15, preferably from about 7 to about 12, and $R^1$ is selected from the group consisting of: preferably, hydrogen, $C_{1-5}$ alkyl groups, $C_{2-5}$ acyl groups and groups having the formula $—(C_yH_{2y}O)_nH$ wherein y is 3 or 4 and n is a number from one to about 4.

Particularly suitable surfactants are the low-sudsing compounds of (4), the other compounds of (5), and the $C_{17-19}$ materials of (1) which have a narrow ethoxy distribution.

In addition to the above mentioned surfactants, other suitable surfactants for detergent compositions can be found in the disclosures of U.S. Pat. Nos. 3,544,473, 3,630,923, 3,888,781 and 4,001,132, all of which are incorporated herein by reference.

Some of the aforementioned surfactants are bleach-stable but some are not. When the composition contains a hypochlorite bleach it is preferable that the detergent surfactant is bleach-stable. Such surfactants desirably do not contain functions such as unsaturation and some aromatic, amide, aldehydic, methyl keto or hydroxyl groups which are susceptible to oxidation by the hypochlorite.

Bleach-stable anionic surfactants which are especially resistant to hypochlorite oxidation fall into two main groups. One such class of bleach-stable anionic surfactants are the water-soluble alkyl sulfates and/or sulfonates, containing from about 8 to 18 carbon atoms in the alkyl group. Alkyl sulfates are the water-soluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, magnesium coconut alkyl sulfate, calcium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable anionic surfactant materials operable in the instant invention are the water-soluble betaine surfactants. These materials have the general formula:

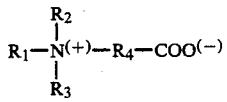

wherein $R_1$ is an alkyl group containing from about 8 to 18 carbon atoms; $R_2$ and $R_3$ are each lower alkyl groups containing from about 1 to 4 carbon atoms, and $R_4$ is an alkylene group selected from the group consisting of methylene, propylene, butylene and pentylene. (Propionate betaines decompose in aqueous solution and hence are not included in the instant compositions).

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dodecyldimethylammonium hexanoate, hexadecyldimethylammonium hexanoate, tetradecyldiethylammonium pentanotate and tetradecyldipropyl ammonium pentanoate. Especially preferred betaine surfactants include dodecyldimethylammonium acetate, dodecyldimethylammonium hexanoate, hexadecyldimethylammonium acetate, and hexadecyldimethylammonium hexanoate.

Nonionic surfactants useful herein include ethoxylated and/or propoxylated nonionic surfactants such as those available from BASF Corp. of New Jersey. Examples of such compounds are polyethylene oxide, polypropylene oxide block copolymers sold under the trade names Pluronic ® and Tetronic ® available from BASF Corp.

Preferred members of this class are capped oxyalkylene oxide block copolymer surfactants of the following structure:

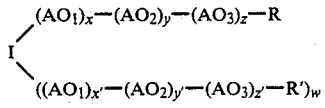

where I is the residue of a monohydroxyl, dihydroxyl, or a polyhydroxyl compound; $AO_1$, $AO_2$, and $AO_3$ are oxyalkyl groups and one of $AO_1$ and $AO_2$ is propylene oxide with the corresponding x or y being greater than zero, and the other of $AO_1$ and $AO_2$ is ethylene oxide with the corresponding x or y being greater than zero, and the molar ratio of propylene oxide to ethylene oxide is from about 2:1 to about 8:1; R and R′ are hydrogen, alkyl, aryl, alkyl aryl, aryl alkyl, carbamate, or butylene oxide; w is equal to zero or one; and z, x′, y′, and z′ are greater than or equal to zero.

Preferably the oxyalkyl groups are oxypropyl, oxyethyl, or oxybutyl, and mixtures thereof; I is the residue of methanol, ethanol, butanol, ethylene glycol, propylene glycol, butylene glycol, bisphenol, glycerine, or trimethylolpropane; and R and R′ are hydrogen, a methyl group, or a butylene oxide group. More preferably in the compounds of this general formula, $AO_1$ is propylene oxide and $AO_2$ is ethylene oxide, and the molar ratio of total propylene oxide to total ethylene oxide is from about 3:1 to about 6:1. Alternatively, compounds of this general formula in which $AO_2$ is propylene oxide and $AO_1$ is ethylene oxide, and the molar ratio of total propylene oxide to total ethylene oxide is from about 3:1 to about 6:1 are also preferred.

Of these compounds, the following structures are preferred:

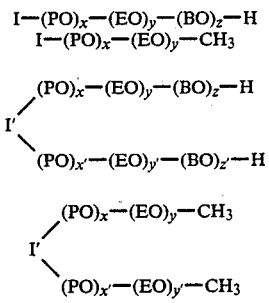

These compounds preferably have molecular weights ranging from about 1000 to about 4000. In these structures I is the residue of a monohydroxyl compound, preferably the residue of methanol, ethanol, or butanol, and I′ is the residue of a dihydroxyl compound, preferably ethylene glycol, propylene glycol, or butylene glycol. Also, EO is an ethylene oxide group; PO is a propylene oxide group; BO is a butylene oxide group; x and x′ are the number of propylene oxide groups; y and y′ are the number of ethylene oxide groups; and z and z′ are the number of butylene oxide groups. Also z and z′ are each greater than zero and preferably are each equal to from about 1 to about 5; x, y, x′, and y′ are each greater than zero, and the ratio of x to y and x′ to y′ is from about 3:1 to about 6:1.

The above structures in which the $(EO)_y$ and $(PO)_x$ sequencing order are reversed are also useful in the present invention. In these reverse structures, y and y′ are the number of propylene oxide groups; x and x′ are the number of ethylene oxide groups; and the ratio of y to x and y′ to x′ is from about 3:1 to about 6:1.

Most preferably the nonionic surfactants comprise the following:

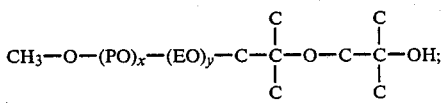

or

-continued

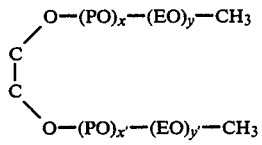

(2)

both molecules having a molecular weight of about 1900, wherein PO is propylene oxide, EO is ethylene oxide, and the molar ratio of PO to EO is from about 4:1 to about 5:1. These surfactants are not only bleach-stable, but they provide low sudsing and superior performance in reducing spotting and filming as well. The preferred of these particular nonionic surfactants is that of formula (1), as this compound is easier to prepare. However, from a bleach stability and performance standpoint, both compounds are equivalent.

Preparation of the compound:

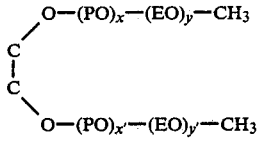

having a molecular weight of about 1900, wherein PO is propylene oxide, EO is ethylene oxide, and the molar ratio of PO to EO is from about 4:1 to about 5:1, is as follows.

The initiator, ethylene glycol, is reacted first with propylene oxide and then with ethylene oxide under base catalysis with KOH to form the potassium salt of the polyol. This is then reacted with either dimethyl sulfate in the presence of sodium hydroxide or with methyl chloride and $CH_3ONa$ or $CH_3OK$ to yield the methyl capped polyalkylene oxide block copolymer nonionic surfactant.

Preparation of the compound:

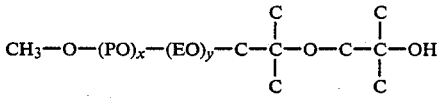

having a molecular weight of about 1900, wherein PO is propylene oxide, EO is ethylene oxide, and the molar ratio of PO to EO is from about 4:1 to about 5:1, is as follows.

The initiator, methanol, is reacted first with propylene oxide and then with ethylene oxide under base catalysis with KOH to yield the potassium salt starting material. A one-gallon Autoclave Engineers, stainless steel autoclave capable of working pressures of up to 150 psig is charged with 2500 g (1.33 moles) of the starting material. The reactor is sealed and evacuated for one hour at 100° C. The temperature is raised to 115° C., and 193 g (2.68 moles) of isobutylene oxide are added over a period of three hours and 45 minutes. Once all of the isobutylene oxide is added, the mixture is allowed to react in the autoclave for three hours. The reaction is complete when the pressure in the autoclave is constant over time with constant temperature. The product is cooled and discharged and subsequently neutralized with phosphoric acid, to yield the isobutylene oxide capped polyalkylene oxide block copolymer nonionic surfactant.

Other bleach-stable surfactants include amine oxides, phosphine oxides, and sulfoxides. However, such surfactants are usually high sudsing. A disclosure of bleach-stable surfactants can be found in published British Patent Application 2,116,199A; U.S. Pat. No. 4,005,027, Hartman; U.S. Pat. No. 4,116,851, Rupe et al; U.S. Pat. No. 3,985,668, Hartman; U.S. Pat. No. 4,271,030, Brierley et al; and U.S. Pat. No. 4,116,849, Leikhim, all of which are incorporated herein by reference.

Other desirable bleach-stable surfactants are the alkyl phosphonates, taught in U.S. Pat. No. 4,105,573, to Jacobsen, issued August 8, 1978, incorporated herein by reference.

Still other preferred bleach-stable anionic surfactants include the linear or branched alkali metal mono- and/or di-($C_{8-14}$) alkyl diphenyl oxide mono- and/or disulphonates, commercially available under the trade names Dowfax 3B-2 (sodium n-decyl diphenyloxide disulfonate) and Dowfax 2A-1. These and similar surfactants are disclosed in published U.K. Patent Applications 2,163,447A; 2,163,448A; and 2,164,350A, said applications being incorporated herein by reference.

Bleaching Agent

The instant compositions optionally and desirably include a bleaching agent which yields a hypochlorite species in aqueous solution. The hypochlorite ion is chemically represented by the formula OCl−. The hypochlorite ion is a strong oxidizing agent, and for this reason materials which yield this species are considered to be powerful bleaching agents.

The strength of an aqueous solution containing hypochlorite ion is measured in terms of available chlorine. This is the oxidizing power of the solution measured by the ability of the solution to liberate iodine from an acidified iodide solution. One hypochlorite ion has the oxidizing power of 2 atoms of chlorine, i.e., one molecule of chlorine gas.

At lower pH levels, aqueous solutions formed by dissolving hypochlorite-yielding compounds contain active chlorine, partially in the form of hypochlorous acid moieties and partially in the form of hypochlorite ions. At pH levels above about 10, i.e., at the preferred pH levels of the instant compositions, essentially all of the active chlorine is in the form of hypochlorite ion.

Those bleaching agents which yield a hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, sodium dichloroisocyanurate, sodium dichloroisocyanurate dihydrate, trichlorocyanuric acid, 1,3-dichloro-5,5-dimethylhydantoin, N-chlorosulfamide, Chloramine T, Dichloramine T, Chloramine B and Dichloramine B. A preferred bleaching agent for use in the compositions of the instant invention is sodium hypochlorite.

Most of the above-described hypochlorite-yielding bleaching agents are available in solid or concentrated form and are dissolved in water during preparation of the compositions of the instant invention. Some of the above materials are available as aqueous solutions.

If present, the above-described bleaching agents are dissolved in the aqueous liquid component of the present composition. Bleaching agents can provide from about 0.1% to 5% available chlorine by weight, preferably from about 0.5% to 2.0% available chlorine by weight, of the total composition.

Buffering Agent

In the instant compositions, it is generally desirable to also include one or more buffering agents capable of maintaining the pH of the compositions within the alkaline range. It is in this pH range that optimum performance of the bleach and surfactant are realized, and it is also within this pH range wherein optimum composition chemical stability is achieved.

When the essential thickening agent is a clay material and when a hypochlorite bleach is optionally included in the instant compositions maintenance of the composition pH within the 10.5 to 12.5 range minimizes undesirable chemical decomposition of the active chlorine, hypochlorite-yielding bleaching agents, said decomposition generally being encountered when such bleaching agents are admixed with clay in unbuffered aqueous solution. Maintenance of this particular pH range also minimizes the chemical interaction between the strong hypochlorite bleach and the surfactant compounds present in the instant compositions. Finally, as noted, high pH values such as those maintained by an optional buffering agent serve to enhance the soil and stain removal properties during utilization of the present compositions.

Any compatible material or mixture of materials which has the effect of maintaining the composition pH within the alkaline pH range, and preferably within the 10.5 to 12.5 range, can be utilized as the buffering agent in the instant invention. Such materials can include, for example, various water-soluble, inorganic salts such as the carbonates, bicarbonates, sesquicarbonates, silicates, pyrophosphates, phosphates, tetraborates, and mixtures thereof. Examples of materials which can be used either alone or in combination as the buffering agent herein include sodium carbonate, sodium bicarbonate, potassium carbonate, sodium sesquicarbonate, sodium silicate, sodium pyrophosphate, tetrapotassium pyrophosphate, tripotassium phosphate, trisodium phosphate, anhydrous sodium tetraborate, sodium tetraborate pentahydrate, potassium hydroxide, sodium hydroxide, and sodium tetraborate decahydrate. Buffering agents for use herein may include mixtures of tetrapotassium pyrophosphate and trisodium phosphate in a pyrophosphate/phosphate weight ratio of about 3:1, mixtures of tetrapotassium pyrophosphate and tripotassium phosphate in a pyrophosphate/phosphate weight ratio of about 3:1, and mixtures of anhydrous sodium carbonate and sodium silicate in a carbonate/silicate weight ratio of about 1:3 to about 3:1, preferably from about 1:2 to about 2:1.

If present, the above-described buffering agent materials are dissolved or suspended in the aqueous liquid component. Buffering agents can generally comprise from about 2% to 20% by weight, preferably from about 5% to 15% by weight, of the total composition.

Detergency Builder

Detergency builders are desirable materials which reduce the free calcium and/or magnesium ion concentration in a surfactant-containing aqueous solution. They are used herein at a level of from about 5% to about 40%, preferably from about 15% to about 30%. The preferred detergency builder for use herein is sodium tripolyphosphate in an amount from about 10% to about 40%, preferably from about 15% to about 30%. Generally a certain percentage of the sodium tripolyphosphate is in an undissolved particulate form suspended in the rest of the detergent composition. The phosphate ester, if present in the composition, works to keep such solid particles suspended in the aqueous solution.

Other detergency builders include potassium pyrophosphate, sodium pyrophosphate, potassium tripolyphosphate, potassium hexametaphosphate, and alkali metal carbonates such as sodium carbonate. Mixtures of these builders may also be utilized.

Some of the above-described buffering agent materials additionally serve as builders. It is preferred that the buffering agent contain at least one compound capable of additionally acting as a builder.

The Thickening Agent

Any material or materials which can be admixed with the aqueous liquid to provide shear-thinning compositions having sufficient yield values can be used in the compositions of this invention. The most common thickening agents are clays, but materials such as colloidal silica, particulate polymers, such as polystyrene and oxidized polystyrene, combinations of certain surfactants, and water-soluble polymers such as polyacrylate are also known to provide yield values.

A synthetic clay that may be used in the compositions of the present invention is the one disclosed in U.S. Pat. No. 3,843,548, incorporated herein by reference. Naturally occurring clays include smectites and attapulgites. These colloidal materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonoids) and attapulgites (or palygorskites).

Smectites are three-layered clays. There are two distinct classes of smectite-clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present compositions in that the expandable characteristics of the hydrated clays are dictated by the silicate lattice structure. Furthermore, atom substitution by iron and magnesium can occur within the crystal lattice of the smectites, while metal cations such as $Na^+$ and $Ca^{++}$, as well as $H^+$, can be copresent in the water of hydration to provide electrical neutrality. Although the presence of iron in such clay material is preferably avoided to minimize adverse reactions, e.g., a chemical interaction between clay and bleach, such cation substitutions in general are immaterial to the use of the clays herein since the desirable physical properties of the clay are not substantially altered thereby.

The layered expandable aluminosilicate smectite clays useful herein are further characterized by a dioctahedral crystal lattice, whereas the expandable magnesium silicate clays have a trioctahedral crystal lattice.

The smectite clays used in the compositions herein are all commercially available. Such clays include for example, montmorillonite (bentonite), volchonskoite, nontronite, beidellite, hectorite, saponite, sauconite and vermiculite. The clays herein are available under commercial names such as "Fooler Clay" (clay found in a relatively thin vein above the main bentonite or montmorillonite veins in the Black Hills) and various trade names such as Thixogel No. 1 and Gelwhite GP from ECC America, Inc. (both montmorillonites); Volclay BC, Volclay No. 325, and especially Volclay HPM-20 and Polar Gel-T from American Colloid Company, Skokie, Illinois; Black Hills Bentonite BH 450, from International Minerals and Chemicals; Veegum Pro and Veegum F, from R. T. Vanderbilt (both hectorites); Barasym NAS-100, Barasym NAH-100, Barasym SMM 200, and Barasym LIH-200, all synthetic hectorites and saponites marketed by Baroid Division, NL, Industries, Inc.

Smectite clays are preferred for use in the instant invention. Montmorillonite, hectorite and saponite are the preferred smectites. Gelwhite GP, Barasym NAS-100, Barasym NAH-100, Polar Gel-T, and Volclay HPM-20 are the preferred montmorillonites, hectorites and saponites.

A second type of expandable clay material useful in the instant invention is classified geologically as attapulgite (palygorskite). Attapulgites are magnesium-rich clays having principles of superposition of tetrahedral and octahedral unit cell elements different from the smectites. An idealized composition of the attapulgite unit cell is given as:

$$(OH_2)_4(OH)_2Mg_5Si_8O_{20}.4H_2O.$$

A typical attapulgite analyses yields 55.02% $SiO_2$; 10.24% $Al_2O_3$; 3.53% $Fe_2O_3$; 10.45% MgO; 0.47% ($K_2O$; 9.73% $H_2O$ removed at 150° C.; 10.13% $H_2O$ removed at higher temperatures.

Like the smectites, attapulgite clays are commercially available. For example, such clays are marketed under the trade name Attagel, i.e. Attagel 40, Attagel 50 and Attagel 150 from Engelhard Minerals & Chemicals Corporation.

Particularly preferred for the colloid-forming clay component in certain embodiments of the instant composition are mixtures of smectite and attapulgite clays. In general, such mixed clay compositions exhibit increased and prolonged fluidity upon application of shear stress but are still adequately thickened solutions at times when flow is not desired. Clay mixtures in a smectite/attapulgite weight ratio of from 5:1 to 1:5 are preferred. Ratios of from 2:1 to 1:2 are more preferred. A ratio of about 1:1 is most preferred.

As noted above, the clays employed in the compositions of the present invention contain cationic counter ions such as protons, sodium ions, potassium ions, calcium ions, magnesium ions and the like. It is customary to distinguish between clays on the basis of one cation which is predominately or exclusively absorbed. For example a sodium clay is one in which the absorbed cation is predominately sodium. Such absorbed cations can become involved in exchange reactions with cations present in aqueous solutions. It is preferred that the present compositions contain up to about 12% or preferably up to about 8% potassium ions since they improve the viscosity increasing characteristics of the clay. Preferably at least 1%, more preferably at least 2% of the potassium ions are present.

Hectorites can also be used, particularly those of the types described in U.S. Pat. Nos. 4,511,487 and 4,512,908, previously incorporated herein by reference.

Specific preferred clays are disclosed in U.S. Pat. Nos. 3,993,573 and 4,005,027, incorporated herein by reference. These materials are preferred for thickening. The amount of clay will normally be from about 25% to about 20%, preferably from about 0.5% to about 12%, more preferably from about 0.5% to about 2%.

If clay is used as a thickening agent in the compositions of the present invention preferably nonionic surfactants are not used. This is because such a composition would not be phase stable.

Other thickening agents which are useful in this invention include those disclosed in U.S. Pat. No. 3,393,153, incorporated herein by reference, including colloidal silica having a mean particle diameter ranging from about 0.01 micron to about 0.05 micron and particulate polymers such as polystyrene, oxidized polystyrene having an acid number of from 20 to about 40, sulfonated polystyrene having an acid number of from about 10 to about 30, polyethylene, oxidized polyethylene having an acid number of from about 10 to about 30; sulfonated polyethylene having an acid number of from about 5 to about 25; polypropylene, oxidized polypropylene having an acid number of from about 10 to about 30 and sulfonated polypropylene having an acid number of from about 5 to about 25, all of said particulate polymers having mean particle diameters ranging from about 0.01 micron to about 30 microns. Other examples include copolymers of styrene with monomers such as maleic anhydride, nitrilonitrile, methacrylic acid and lower alkyl esters of methacrylic acid. Other materials include copolymers of styrene with methyl or ethyl acrylate, methyl or ethyl maleate, vinyl acetate, acrylic maleic or fumaric acids and mixtures thereof. The mole ratio of ester and/or acid to styrene being in the range from about 4 to about 40 styrene units per ester and/or acid unit. The latter materials having a mean particle diameter range of from about 0.05 micron to about 1 micron and molecular weights ranging from about 500,000 to about 2,000,000.

Still other thickening agents useful herein are described in U.S. Pat. No. 4,226,736 to Bush et al, issued Oct. 7, 1980 and incorporated herein by reference.

The compositions contain from about 0.1% to about 20%, preferably from about 0.3% to about 15%, most preferably from about 0.5% to about 5% of thickening agent.

Polycarboxylate Polymer

A preferred thickening agent useful in the compositions of the present invention is a high molecular weight polycarboxylate polymer thickener. By "high molecular weight" is meant from about 500,000 to about 5,000,000, preferably from about 750,000 to about 4,000,000.

The polycarboxylate polymer may be a carboxyvinyl polymer. Such compounds are disclosed in U.S. Pat. No. 2,798,053, issued on July 2, 1957, to Brown, the specification of which is hereby incorporated by reference. Methods for making carboxyvinyl polymers are also disclosed in Brown.

A carboxyvinyl polymer is an interpolymer of a monomeric mixture comprising a monomeric olefinically unsaturated carboxylic acid, and from about 0.1% to about 10% by weight of the total monomers of a polyether of a polyhydric alcohol, which polyhydric alcohol contains at least four carbon atoms to which are attached at least three hydroxyl groups, the polyether containing more than one alkenyl group per molecule. Other monoolefinic monomeric materials may be present in the monomeric mixture if desired, even in predominant proportion. Carboxyvinyl polymers are substantially insoluble in liquid, volatile organic hydrocarbons and are dimensionally stable on exposure to air.

Preferred polyhydric alcohols used to produce carboxyvinyl polymers include polyols selected from the class consisting of oligosaccharides, reduced derivatives thereof in which the carbonyl group is converted to an alcohol group, and pentaerythritol; more preferred are oligosaccharides, most preferred is sucrose. It is preferred that the hydroxyl groups of the polyol which are modified be etherified with allyl groups, the polyol having at least two allyl ether groups per polyol molecule. When the polyol is sucrose, it is preferred that the sucrose have at least about five allyl ether groups per sucrose molecule. It is preferred that the polyether of the polyol comprise from about 0.1% to about 4% of the total monomers, more preferably from about 0.2% to about 2.5%.

Preferred monomeric olefinically unsaturated carboxylic acids for use in producing carboxyvinyl polymers used herein include monomeric, polymerizable, alpha-beta monoolefinically unsaturated lower aliphatic carboxylic acids; more preferred are monomeric monoolefinic acrylic acids of the structure

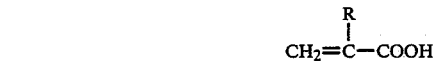

where R is a substituent selected from the group consisting of hydrogen and lower alkyl groups; most preferred is acrylic acid.

Carboxyvinyl polymers useful in formulations of the present invention have a molecular weight of at least about 750,000; preferred are highly cross-linked carboxyvinyl polymers having a molecular weight of at least about 1,250,000; also preferred are carboxyvinyl polymers having a molecular weight of at least about 3,000,000, which may be less highly cross-linked.

Various carboxyvinyl polymers are commercially available from B. F. Goodrich Company, New York, N.Y., under the trade name Carbopol. Carboxyvinyl polymers useful in formulations of the present invention include Carbopol 910 having a molecular weight of about 750,000, preferred Carbopol 941 having a molecular weight of about 1,250,000, and more preferred Carbopols 934 and 940 having molecular weights of about 3,000,000 and 4,000,000, respectively.

Carbopol 934 is a very slightly cross-linked carboxyvinyl polymer having a molecular weight of about 3,000,000. It has been described as a high molecular weight polyacrylic acid cross-linked with about 1% of polyallyl sucrose having an average of about 5.8 allyl groups for each molecule of sucrose.

Additional polycarboxylate polymers useful in the present invention are Sokolan PHC-25 ®, a polyacrylic acid available from BASF Corp. and Gantrez ® a poly(methyl vinyl ether/maleic acid) interpolymer available from GAF Corp.

Preferred polycarboxylate polymers of the present invention are non-linear, water-dispersible, polyacrylic acid cross-linked with a polyalkenyl polyether and having a molecular weight of from about 750,000 to about 4,000,000.

Highly preferred examples of these polycarboxylate polymer thickeners for use in the present invention are the Carbopol 600 series resins available from B. F. Goodrich. Especially preferred are Carbopol 616 and 617. It is believed that these resins are more highly cross-linked than the 900 series resins and have molecular weights between about 1,000,000 and 4,000,000. Mixtures of polycarboxylate polymers as herein described may also be used in the present invention. Particularly preferred is a mixture of Carbopol 616 and 617 series resins.

The polycarboxylate polymer thickener is utilized preferably with essentially no clay thickening agents. In fact, it has been found that if the polycarboxylate polymers of the present invention are utilized with clay in the composition of the present invention, a less desirable product results in terms of phase instability. In other words, the polycarboxylate polymer is preferably used instead of clay as a thickening/stabilizing agent in the present compositions.

The polycarboxylate polymer also provides a reduction in what is commonly called "bottle hang-up". This term refers to the inability to dispense all of the dishwashing detergent product from its container. Without wishing to be bound by theory, it is believed that the compositions of the present invention provide this benefit because the force of cohesion of the composition is greater than the force of adhesion to the container wall. With clay thickener systems, which most commercially available products contain, bottle hang-up can be a significant problem under certain conditions.

Without wishing to be bound by theory, it is also believed that the long chain molecules of the polycarboxylate polymer thickener help to suspend solids in the detergent compositions of the present invention and help to keep the matrix expanded. The polymeric material is also less sensitive than clay thickeners to destruction due to repeated shearing, such as occurs when the composition is vigorously mixed.

If the polycarboxylate polymer is used as the thickening agent in the compositions of the present invention, it is present at a level of from about 0.1% to about 10%, preferably from about 0.2% to about 2%.

The thickening agents are used to provide a yield value of from about 50 to about 350 and most preferably from about 75 to about 250.

Yield Value Analysis

The yield value is an indication of the shear stress at which the gel strength is exceeded and flow is initiated. It is measured herein with a Brookfield RVT model viscometer with a T-bar B spindle at 25° C. utilizing a Helipath drive upward during associated readings. The system is set to 0.5 rpm and a reading is taken for the composition to be tested after 30 seconds or after the system is stable. The system is stopped and the rpm is reset to 1.0 rpm. A reading is taken for the same composition after 30 seconds or after the system is stable. Stress at zero shear is equal to two times the 0.5 rpm reading minus the reading at 1.0 rpm. The yield value is calculated as the stress at zero shear times 18.8 (conversion factor).

Phosphate Ester

The compositions of the present invention which comprise a polycarboxylate thickener may also comprise certain esters of phosphoric acid (phosphate ester) for enhanced phase stability. Phosphate esters are any materials of the general formula:

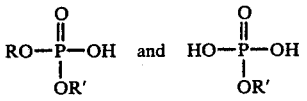

wherein R and R′ are $C_6$–$C_{20}$ alkyl or ethoxylated alkyl groups. Preferably R and R′ are of the general formula: alkyl—$(OCH_2CH_2)_Y$ wherein the alkyl substituent is $C_{12}$–$C_{18}$ and Y is between 0 and about 4. Most preferably the alkyl substituant of that formula is $C_{12}$–$C_{18}$ and Y is between about 2 and about 4. Such compounds are prepared by known methods from phosphorus pentoxide, phosphoric acid, or phosphorus oxy halide and alcohols or ethoxylated alcohols.

It will be appreciated that the formula depicted represent mono- and di-esters, and commercial phosphate esters will generally comprise mixtures of the mono- and di-esters, together with some proportion of tri-ester. Typical commercial esters are available under the trademarks "Phospholan" PDB3 (Diamond Shamrock), "Servoxyl" VPAZ (Servo), PCUK-PAE (BASF-Wyandotte), SAPC (Hooker). Preferred for use in the present invention are KN340N and KL340N (Hoescht) and monostearyl acid phosphate (Oxidental Chemical Corp.). Most preferred for use in the present invention is Hostophat-TP-2253 (Hoescht).

The phosphate ester component aids in control of specific gravity of the detergent products of the present invention. The phosphate ester component also helps to maintain stability of the product.

The phosphate esters useful herein also provide protection of silver and silver-plated utensil surfaces. The phosphate ester component also acts as a suds suppressor; thus an additional suds suppressor is not required in the anionic surfactant-containing detergent compositions disclosed herein.

These phosphate esters in combination with the polycarboxylate polymer thickener provide enhanced stability to the liquid automatic dishwashing detergent compositions of the present invention. More specifically, the phosphate ester component helps to keep the solid particles in the compositions of the present invention in suspension. Thus, the combination inhibits the separation out of a liquid layer from compositions of this type.

From about 0.1% to about 5%, preferably from about 0.15% to about 1.0% of the phosphate ester component is used in the compositions of the present invention.

Other Optional Materials

Conventional coloring agents and perfumes can also be added to the instant compositions to enhance their aesthetic appeal and/or consumer acceptability. These materials should, of course, be those dye and perfume varieties which are especially stable against degradation by high pH and/or strong active chlorine bleaching agents if such bleaching agents are also present.

If present, the above-described other optional materials generally comprise no more than about 10% by weight of the total composition and are dissolved, suspended, or emulsified in the present compositions.

Entrained Gas

Optionally, the compositions of the present invention may comprise entrained gas to further ensure stability.

The entrained gas can be any gaseous material that is insoluble in the aqueous liquid. Air is preferred, but any gas that will not react with the composition, such as nitrogen, is also useful.

The entrained gas bubbles are preferably in very finely divided form, preferably less than about 1/32 in. in diameter. They are dispersed throughout the aqueous liquid in an amount, generally from about 1% to about 20%, preferably from about 5% to about 15% by volume, to lower the specific gravity of the overall composition to within from about 5% more than to about 10% less than, preferably within from about 1% more than to about 5% less than the specific gravity of the aqueous liquid without the entrained gas. It is more desirable to be below the specific gravity of the aqueous phase. Any phase separation is then at the bottom of the container, and pouring will tend to remix the separated phase before it is dispensed.

The gas can be admixed with high shear mixing, e.g., through a shear device that has close tolerances to achieve air bubble size reduction. High shear mixing can be attained with shear rates greater than about 1000 $sec^{-1}$, preferably greater than about 15,000 $sec^{-1}$, most preferably greater than 30,000 $sec^{-1}$. The thickening agent (clay or polymeric), on the other hand, should preferably be added last to minimize excessive exposure to shear. Each of these preferred processing steps gives compositions with superior stability. The gas can also be introduced in finely divided form by using a sparger.

Preferred Composition

Preferred compositions of this invention are liquid aqueous automatic dishwasher detergent compositions comprising:

(1) from about 15% to about 30% of sodium tripolyphosphate;
(2) from about 4% to about 10% of sodium silicate;
(3) from about 3% to about 10% of sodium carbonate;
(4) hypochlorite bleach in an amount to provide from about 0.5% to about 1.5% of available chlorine;
(5) from about 0.1% to about 1.5% of sodium n-decyl diphenyloxide disulfonate;
(6) from about 0.2% to about 2% of a polycarboxylate polymer thickening agent selected from the group consisting of polycarboxylate polymers comprising non-linear, water-dispersible, polyacrylic acid cross-linked with a polyalkenyl polyether and having a molecular weight of from about 750,000 to about 3,000,000, and mixtures thereof;
(7) from about 0.15% to about 1.0% of an ethoxylated alkyl ester of phosphoric acid having an average alkyl chain length of from about 12 to about 18 carbon atoms and an average number of ethoxylate units of from about 2 to about 4; and
(8) from about 0.05% to about 0.2% of lithium hydroxystearate;

said liquid detergent containing no clay suspension agents and having a yield value of from about 100 to about 250.

Alternatively, item (5) of the composition may comprise from about 0.5% to about 1.5% of a nonionic surfactant of the following structure:

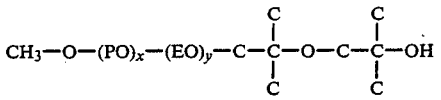

having a molecular weight of about 1900, wherein PO is propylene oxide, EO is ethylene oxide, and the molar ratio of PO to EO is from about 4:1 to about 5:1.

The following examples illustrate the present invention. It will be appreciated that other modifications of the present invention, within the skill of those in the automatic liquid dishwashing detergency art, can be undertaken without departing from the spirit and scope of this invention.

All parts, percentages, and ratios herein are by weight unless otherwise specified.

EXAMPLE I

A liquid automatic dishwashing detergent composition of the present invention is as follows:

| Component | Wt. % |
|---|---|
| Sodium tripolyphosphate (anhydrous basis) | 23.4 |
| Sodium silicate solids (2.4R) | 7.0 |
| Sodium carbonate | 6.0 |
| Available chlorine from sodium hypochlorite | 1.0 |
| Clay (Volclay HPM-20) | 1.0 (±20%) |
| Sodium hydroxide | 0.7 |
| Monostearyl acid phosphate (suds suppressor) | 0.03 |
| Anionic surfactant (Dowfax 3B2) | 0.4 |
| Lithium hydroxystearate | 0.3 |
| Minor ingredients and water | Balance |

The composition is prepared as follows. The NaOCl, NaOH, sodium silicate, perfume, and water are combined in a stainless steel container which is placed in an ice bath. A Ross mixer is used to high shear mix the contents of the container while adding the sodium tripolyphosphate (anhydrous) and the sodium carbonate. Mixing is continued until the particle size is acceptably small, i.e. no visible chunks of sodium tripolyphosphate or sodium carbonate particles can be seen in a thin film of the mixture on a stainless steel spatula. Mixing is continued as the monostearyl acid phosphate, anionic surfactant, and lithium hydroxystearate are added. Mixing is continued until the specific gravity of the mixture is about 1.27. Mixing is stopped and the container is removed from the ice bath. A paddle mixer is then placed into the mixture. The dye is then paddled into the mixture. The clay is then paddled into the mixture, just until incorporated.

This liquid dishwashing detergent has a pH of about 12.2, a yield value of about 250, and a specific gravity of about 1.23. This detergent composition provides enhanced protection against silver tarnishing in the dishwasher.

EXAMPLE II

A liquid automatic dishwashing detergent composition of the present invention is as follows:

| Component | Wt. % |
|---|---|
| Hexahydrate sodium tripolyphosphate | 12.8 |
| Sodium tripolyphosphate (anhydrous basis) | 10.0 |
| Sodium silicate solids (2.4R) | 7.0 |
| Sodium carbonate | 6.0 |
| Available chlorine from sodium hypochlorite | 1.0 |

-continued

| Component | Wt. % |
|---|---|
| Polyacrylate thickener-Carbopol 616 | 0.2 |
| Polyacrylate thickener - Carbopol 617 | 0.25 |
| Ethoxylated phosphate ester-Hostophat TP-2253 | 0.2 |
| Sodium hydroxide | 0.95 |
| Anionic surfactant (Dowfax 3B2) | 0.4 |
| Lithium hydroxystearate | 0.1 |
| Minor ingredients and water | Balance |

The composition is prepared as follows. The NaOCl, NaOH, sodium silicate, perfume and water are combined in a stainless steel container which is placed in an ice bath. A Ross mixer is used to high shear mix the contents of the container while adding the hexahydrate sodium tripolyphosphate, the sodium tripolyphosphate (anhydrous) and the sodium carbonate. Mixing is continued until the particle size is acceptably small, i.e. no visible chunks of sodium tripolyphosphate or sodium carbonate particles can be seen in a thin film of the mixture on a stainless steel spatula. Mixing is continued as the phosphate ester, anionic surfactant and lithium hydroxysterate are added. Mixing is continued until the specific gravity of the mixture is about 1.27. Mixing is then stopped and the container is removed from the ice bath. A paddle mixer is then placed into the mixture. The dye is then paddled into the mixture. In a separate container the polycarboxylate polymer is premixed with enough water to moisten the polymer. The polymer slurry (2.5%) is then paddled into the mixture of the other components.

This liquid dishwashing detergent has a pH of about 12.2, a yield value of about 200, and a specific gravity of about 1.23. This detergent composition provides enhanced protection against silver tarnishing in the dishwasher. This detergent composition has enhanced phase stability when compared with similar products thickened with clay or other colloid thickeners. This enhanced phase stability can be seen when the composition of the present invention is stored at 25° C. for four months; no separation out of a liquid phase results. This is comparable to at least 1% separation out of a liquid phase for traditional clay-thickened automatic dishwashing detergent compositions in a much shorter period of time. This detergent also provides reduced bottle hang-up.

Other compositions of the present invention are obtained when the Carbopol polyacrylate thickeners are replaced in whole or in part with polyacrylate polymers sold under the trade names Sokalan PHC-25®, available from BASF Corp., or Gantrez®, available from GAF Corp.

Other compositions of the present invention are obtained when the Hostophat TP-2253 ethoxylated phosphate ester is replaced in whole or in part with phosphate esters sold under the trade names KW340N or KL340N, available from Hoescht, or monostearyl acid phosphate, available from Oxidental Chemical Corp.

Yet other compositions of the present invention are obtained when the lithium hydroxystearate is replaced in whole or in part with other metal salts of long chain hydroxy fatty acids, for example, sodium-, potassium-, aluminium-, or zinc hydroxystearate or potassium-, sodium-, lithium-, aluminum-, or zinc hydroxylaurate, -palmitate, -myristate, -oleate, etc.

EXAMPLE III

A liquid automatic dishwashing detergent composition of the invention is as follows:

| Component | Wt. % |
|---|---|
| Sodium tripolyphosphate (anhydrous basis) | 20.0 |
| Capped polyalkylene oxide block copolymer Nonionic surfactant of the following formula: | 1.0 |

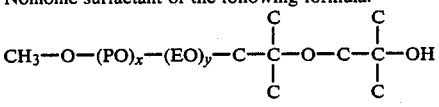

| | |
|---|---|
| Sodium carbonate | 6.0 |
| Sodium hydroxide | 0.95 |
| Available chlorine from sodium hypochlorite | 1.0 |
| Sodium silicate (2.4R) | 7.0 |
| Lithium hydroxystearate | 0.1 |
| Polyacrylate thickener-Carbopol 616 | 0.20 |
| Polyacrylate thickener - Carbopol 617 | 0.25 |
| Ethoxylated phosphate ester-Hostophat TP-2253 | 0.20 |

The composition is prepared as follows. The NaOCl, NaOH, sodium silicate, perfume, lithium hydroxystearate, phosphate ester and water are combined in a stainless steel container which is placed in an ice bath. A Ross mixer is used to high shear mix the contents of the container while adding the hexahydrate sodium tripolyphosphate, the sodium tripolyphosphate (anhydrous) and the sodium carbonate. Mixing is continued until the particle size is acceptably small, i.e. no visible chunks of sodium tripolyphosphate or sodium carbonate particles can be seen in a thin film of the mixture on a stainless steel spatula. Mixing is continued as the nonionic surfactant is added. Mixing is then stopped and the container is removed from the ice bath. A paddle mixer is then placed into the mixture. The dye is then paddled into the mixture. In a separate container the polycarboxylate polymer is premixed with enough water to moisten the polymer. The polymer slurry (2.5%) is then paddled into the mixture of the other components.

The resulting automatic dishwashing detergent composition has a pH (1% solution) of about 11, a yield value of about 180, and a specific gravity of about 1.32. This detergent composition provides enhanced protection against silver tarnishing in the dishwasher. This detergent composition has enhanced phase stability when compared with similar products thickened with clay or other colloid thickeners. This detergent also provides reduced bottle hang-up.

Another composition of the present invention is obtained when the nonionic surfactant is replaced with a compound of the following formula:

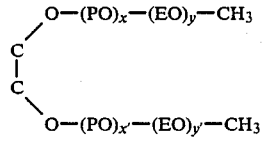

having a molecular weight of about 1900, wherein PO is propylene oxide, EO is ethylene oxide, and the molar ratio of PO to EO is from about 4:1 to 5:1.

Other compositions of the present invention are obtained when the Carbopol polyacrylate thickeners are replaced in whole or in part with polyacrylate polymers sold under the trade names Sokalan PHC-25 ®, available from BASF Corp., or Gantrez ®, available from GAF Corp.

Other compositions of the present invention are obtained when the Hostophat TP-2253 ethoxylated phosphate ester is replaced in whole or in part with phosphate esters sold under the trade names KW340N or KL340N, available from Hoescht, or monostearyl acid phosphate, available from Oxidental Chemical Corp.

Yet other compositions of the present invention are obtained when the lithium hydroxystearate is replaced in whole or in part with other metal salts of long chain hydroxy fatty acids, for example, sodium-, potassium-, aluminium-, or zinc hydroxystearate or potassium-, sodium-, lithium-, aluminum-, or zinc hydroxylaurate, -palmitate, -myristate, -oleate, etc.

What is claimed is:

1. A liquid automatic dishwashing detergent composition comprising:

(a) from 0% to about 5% of bleach-stable surfactant;
(b) from about 5% to about 40% of detergency builder;
(c) hypochlorite bleach to yield available chlorine in an amount of from about 0.3% to about 2.5%;
(d) from about 0.25% to 20% of a thickening agent;
(e) from about 0.05% to about 0.3% of a metal salt of a long chain hydroxy fatty acid to inhibit tarnishing in silverware; and
(f) the balance being water and minor ingredients; said composition having a yield value of from about 50 to about 350 dynes/cm$^2$.

2. The composition of claim 1 wherein said metal salt of a long chain hydroxy fatty acid comprises a metal salt of a higher aliphatic hydroxy fatty acid having from about 8 to about 22 carbon atoms.

3. The composition of claim 2 wherein said metal salt of a long chain hydroxy fatty acid comprises a metal salt of a higher aliphatic hydroxy fatty acid having from about 12 to about 18 carbon atoms.

4. The composition of claim 3 wherein said metal salt of a long chain hydroxy fatty acid is selected from the group consisting of sodium, potassium, lithium, aluminum and zinc salts of a long chain hydroxy fatty acid.

5. The composition of claim 4 wherein the thickening agent is a high molecular weight polycarboxylate polymer thickening agent.

6. The composition of claim 5 wherein said metal salt of a long chain hydroxy fatty acid comprises a metal salt of hydroxystearic acid.

7. The composition of claim 6 wherein said metal salt of hydroxystearic acid is lithium hydroxystearate.

8. The composition of claim 7 which comprises from about 0.1% to about 5% of said bleach-stable surfactant and wherein said surfactant is a nonionic surfactant and is selected from the group consisting of

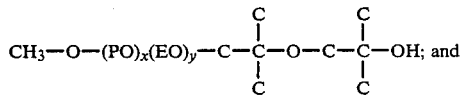

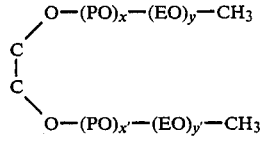

having molecular weights of about 1900, wherein PO is propylene oxide, EO is ethylene oxide, and the molar ratio of PO to EO is from about 4:1 to about 5:1, and mixtures thereof.

9. The composition of claim 8 wherein said detergency builder is selected from the group consisting of sodium tripolyphosphate, sodium carbonate, potassium pyrophosphate, sodium pyrophosphate, and mixtures thereof.

10. The composition of claim 9 which additionally comprises from about 4% to about 10% of sodium silicate.

11. The composition of claim 10 which additionally comprises from about 0.5% to about 1.5% sodium hydroxide.

12. The composition of claim 5 which additionally comprises from about 0.1% to about 5% of a $C_{12}$–$C_{18}$ alkyl ester of phosphoric acid.

13. The composition of claim 12 wherein the $C_{12}$–$C_{18}$ alkyl ester of phosphoric acid comprises from about 0.15% to about 1.0% of the composition.

14. The composition of claim 13 wherein the alkyl ester of phosphoric acid is an ethoxylated alkyl ester of phosphoric acid.

15. The composition of claim 14 wherein said alkyl ester of phosphoric acid has up to about 4 ethoxylate units.

16. The composition of claim 15 wherein said ethoxylated alkyl ester of phosphoric acid has an average alkyl chain length of from about 12 to about 18 carbon atoms and an average number of ethoxylate units of from about 2 to about 4.

17. The composition of claim 5 wherein the polycarboxylate polymer thickening agent comprises from about 0.2% to about 2% of the composition.

18. The composition of claim 17 wherein the polycarboxylate polymer thickening agent is selected from the group consisting of polycarboxylate polymers comprising non-linear, water-dispersible polyacrylic acid cross-linked with polyalkenyl polyether having a molecular weight of from about 750,000 to about 4,000,000; and mixtures thereof.

19. The composition of claim 4 which comprises from about 0.1% to about 5% of said bleach-stable surfactant and wherein said surfactant is an anionic surfactant and is selected from the group consisting of $C_{8-18}$ alkyl sulfates, $C_{8-18}$ alkyl sulfonates, and mixtures thereof.

20. The composition to claim 1 wherein the thickening agent is a clay thickening agent.

21. The composition of claim 20 wherein the clay thickening agent is selected from the group consisting of smectite and attapulgite clays and mixtures thereof.

22. The composition of claim 21 wherein the clay thickening agent comprises from about 0.5% to about 2% of the composition.

23. A method for inhibiting silver tarnishing of dishware in an automatic dishwashing process comprising contacting the silver with washwater containing the composition of claim 1.

24. A liquid automatic dishwashing detergent composition comprising:

(a) from about 15% to about 30% of sodium tripolyphosphate;

(b) from about 4% to about 10% of sodium silicate;

(c) from about 3% to about 10% of sodium carbonate;

(d) hypochlorite bleach in an amount to provide from about 0.5% to about 1.5% of available chlorine;

(e) from about 0.1% to about 1.5% of

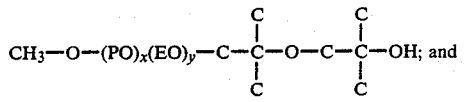

having a molecular weight of about 1900, wherein PO is propylene oxide, EO is ethylene oxide and the ratio of PO to EO is from about 4:1 to about 5:1;

(f) from about 0.2% to about 2% of a polycarboxylate polymer thickening agent selected from the group consisting of polycarboxylate polymers comprising non-linear, water-dispersible polyacrylic acid cross-linked with a polyalkenyl polyether and having a molecular weight of from about 750,000 to about 4,000,000, and mixtures thereof;

(g) from about 0.15% to about 1% of an ethoxylated alkyl ester of phosphoric acid having an average alkyl chain length of from about 12 to about 18 carbon atoms and an average number of ethoxylate units of from about 2 to about 4;

(h) from about 0.05% to about 0.2% of lithium hydroxystearate to inhibit tarnishing in silverware; and (i) the balance being water and minor ingredients;

said liquid detergent containing no clay suspension agents and having a yield value of from about 100 to about 250.

25. A method for inhibiting silver tarnishing of dishware in an automatic dishwashing process comprising contacting the silver with washwater containing the composition of claim 24.

26. A liquid automatic dishwashing detergent composition comprising:

(a) from about 15% to about 30% of sodium tripolyphosphate;

(b) from about 4% to about 10% of sodium silicate;

(c) from about 3% to about 10% of sodium carbonate;

(d) hypochlorite bleach in an amount to provide from about 0.5% to about 1.5% of available chlorine;

(e) from about 0.1% to about 1.5% of sodium n-decyl diphenyloxide disulfonate;

(f) from about 0.2% to about 2% of a polycarboxylate polymer thickening agent selected from the group consisting of polycarboxylate polymers comprising non-linear, water-dispersible polyacrylic acid cross-linked with a polyalkenyl polyether and having a molecular weight of from about 750,000 to about 4,000,000, and mixtures thereof;

(g) from about 0.15% to about 1% of an ethoxylated alkyl ester of phosphoric acid having an average alkyl chain length of from about 12 to about 18 carbon atoms and an average number of ethoxylate units of from about 2 to about 4;

(h) from about 0.05% to about 0.2% of lithium hydroxystearate to inhibit tarnishing in silverware; and (i) the balance being water and minor ingredients;

said liquid detergent containing no clay suspension agents and having a yield value of from about 100 to about 250.

27. A method for inhibiting silver tarnishing of dishware in an automatic dishwashing process comprising contacting the silver with washwater containing the composition of claim 26.

* * * * *